US005688180A

United States Patent [19]

Siragusa, Jr. et al.

[11] Patent Number: 5,688,180

[45] Date of Patent: Nov. 18, 1997

[54] TWO-SURFACE, REVERSIBLE SLIDE

[75] Inventors: Ross D. Siragusa, Jr.; Wesley D. Sutton, both of Fort Payne; Brian Henry, Rainsville, all of Ala.

[73] Assignee: Gametime, Inc., Ft. Payne, Ala.

[21] Appl. No.: 696,613

[22] Filed: Aug. 14, 1996

[51] Int. Cl.[6] ..... A63G 21/00

[52] U.S. Cl. ..... 472/116; 472/88

[58] Field of Search ..... 472/88, 90, 116, 472/117; 104/53, 69, 70; 482/35

[56] References Cited

U.S. PATENT DOCUMENTS

| | | | |
|---|---|---|---|
| D. 217,172 | 4/1970 | Schumm | D21/4 |
| 909,480 | 1/1909 | Tothill | 472/116 |
| 3,556,522 | 1/1971 | Gale | 472/116 |
| 3,715,120 | 2/1973 | Peltola | 472/116 |
| 3,780,469 | 12/1973 | Hancovsky | 446/127 |
| 3,831,934 | 8/1974 | Hancovsky | 472/114 |
| 4,149,710 | 4/1979 | Rouchard | 472/88 |
| 4,379,551 | 4/1983 | Ahrens | 472/116 |
| 4,487,411 | 12/1984 | Ahrens | 472/116 |

OTHER PUBLICATIONS

GameTime, Inc., "Park & Playground 1995", (1994), pp. 90, 91, 92 and 93.

*Primary Examiner*—Kien T. Nguyen
*Attorney, Agent, or Firm*—Welsh & Katz, Ltd.

[57] ABSTRACT

A molded, two-surface, reversible slide, includes first and second elongated sliding surfaces. Each of the sliding surfaces has a bottom portion defining a generally, concave cross-sectional shape, and is elongated in a direction transverse to the concave cross-section. Each surface has a pair of side walls extending from its respective bottom portion. The reversible configuration is effected by first and second sliding surfaces which are in a back-to-back relation with one another. The side walls of the first surface are formed contiguous with a respective one of the side walls of the second sliding surface, defining first and second outer walls. The slide may be used as part of a slide system which includes a slide support structure and one or more slides.

10 Claims, 4 Drawing Sheets

TWO-SURFACE, REVERSIBLE SLIDE

FIELD OF THE INVENTION

This invention relates to slides, such as playground slides. More particularly, the invention relates to molded, reversible slides having two sliding surfaces.

BACKGROUND OF THE INVENTION

Slides, such as playground slides, are well known in the art. Such slides typically include a surface secured to a support at an angle inclined to the ground. Such surfaces may include wood, metal, plastic and like surfaces which have a relatively low friction coefficient, or which can be treated to reduce the friction coefficient thereof. For safety reasons, side rails or walls have been mounted to the sides of such slide surfaces to prevent users from falling off of the sides of the slide.

One presently known form of playground slide is molded from plastic material, such as polyethylene and the like. Due to the nature of the tooling required for such molding processes, slides typically are molded in a single or limited number of predetermined configurations. Essentially, the cost of tooling makes it uneconomical to manufacture limited quantities of custom designed slides.

Nevertheless, in order to enhance the enjoyment of slide systems, it is desirable to configure such slide systems with a variety of differing slide configurations. The differing slide configurations provide not only an assortment of play areas for a child, but may also permit slide systems to be installed in limited spaces which would not otherwise accommodate a slide system Accordingly, there continues to be a need for a slide system which uses a single slide design, which design permits the slide to be used in a variety of slide system design configurations.

SUMMARY OF THE INVENTION

A molded, two-surface, reversible slide includes first and second elongated sliding surfaces. Each surface has a bottom portion which, in part, defines a generally, concave cross-sectional shape. The surfaces are elongated in a direction transverse to the concave cross-section. Each surface includes a pair of side walls extending from the bottom portion.

The first and second sliding surfaces are in back-to-back relation with one another. Each of the side walls of the first surface is formed contiguous with a respective one of the side walls of the second sliding surface. The contiguous side walls define first and second outer walls.

In a preferred configuration, the first and second sliding surfaces are reverse mirror images of one another. Preferably, the first and second sliding surfaces each include at least one curved portion therein extending along the elongated dimension.

A slide system in accordance with the present invention includes a slide support or slide tower and at least one slide mounted thereto. Such a slide system may include a pair of identical slides mounted thereto, having one of the slides mounted with the first surface in an upward or usable orientation and having the other of the slides mounted with the second sliding surface in the usable or upward orientation.

Other features and advantages of the present invention will be apparent from the following detailed description, the accompanying drawings, and the appended claims.

DETAILED DESCRIPTION OF THE PREFERRED EMBODIMENT

Figure 1:
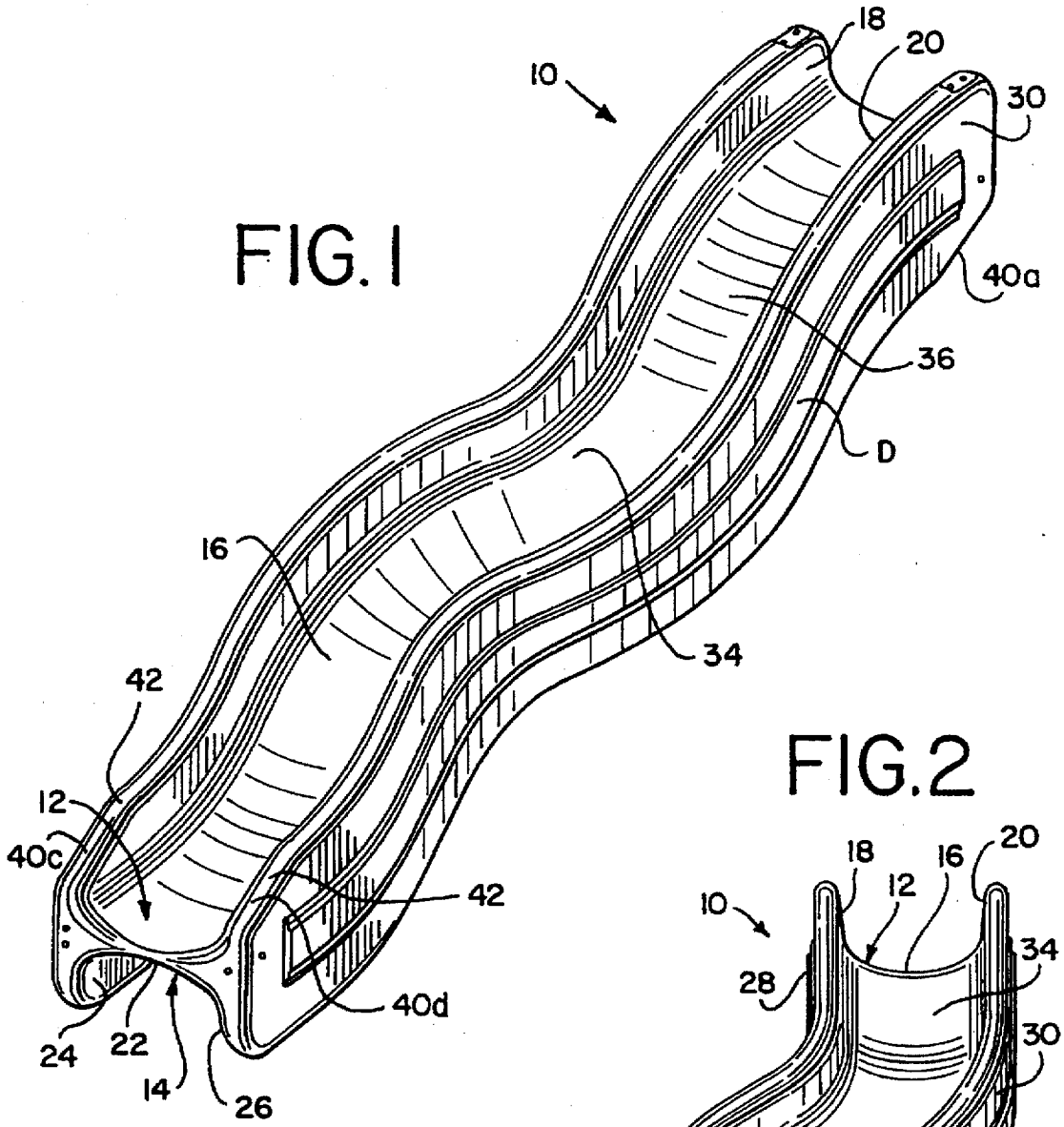
FIG. 1 is a perspective view of an embodiment of a reversible, two-surface slide embodying the principles of the present invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

With reference now to the figures, and particularly to FIG. 1, there is shown a reversible, two-surface slide 10 embodying the principles of the present invention. The slide 10 includes first and second opposingly oriented, elongated sliding surfaces 12, 14. The sliding surfaces 12, 14 are elongated in a generally vertical direction.

As illustrated in FIG. 1, the first sliding surface 12 has a bottom portion 16 on which a user can slide, and a pair of upstanding side walls 18, 20 extending upward from the bottom portion 16. The side walls 18, 20 are configured to prevent a user from falling off of the slide 10, or over the sides 18, 20 of the slide, when in use.

Figure 2:
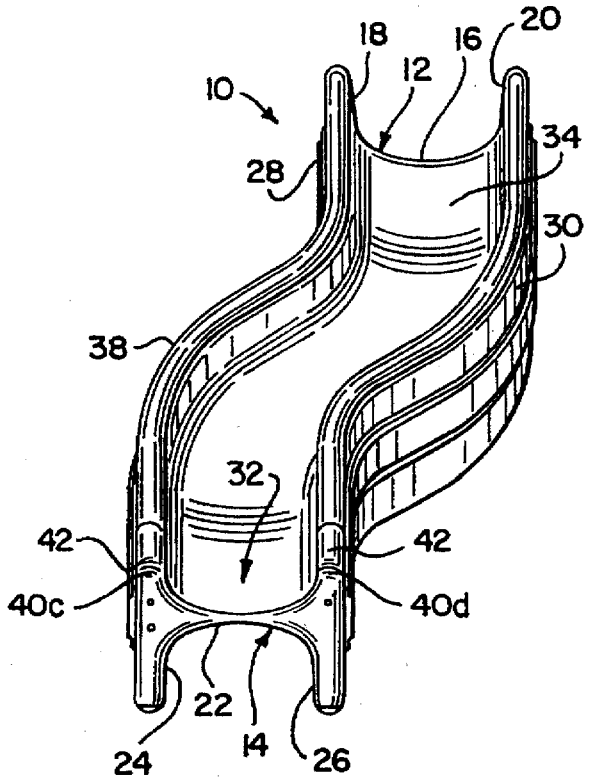
FIG. 2 is a front view of the slide of FIG. 1.
Figure 3:
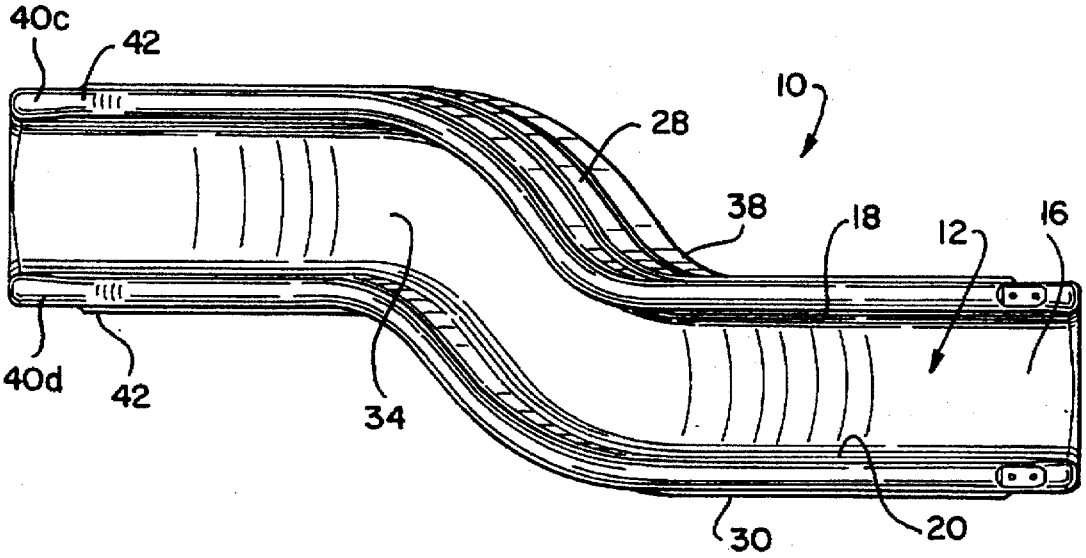
FIG. 3 is a top view of the slide of FIG. 1.
Figure 4:
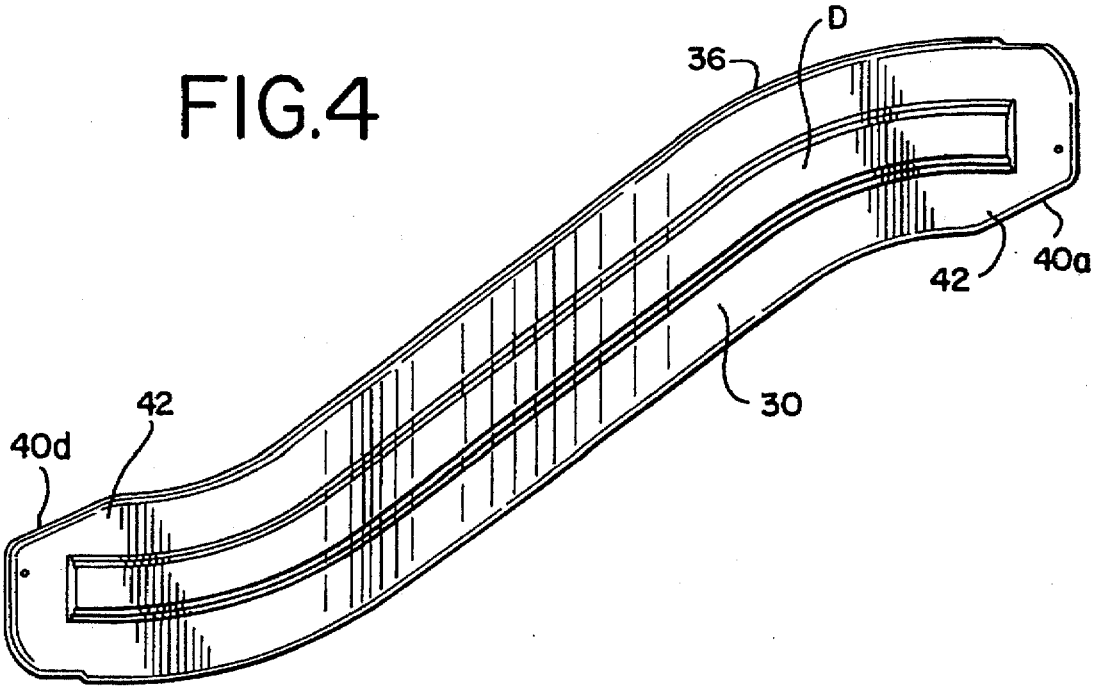
FIG. 4 is a side view of the slide of FIG. 1, as viewed from the right hand side thereof.

Referring to FIGS. 1 and 2, the first sliding surface 12 is illustrated in an upward or usable orientation. The second sliding surface 14 is illustrated in a downward orientation.

Similar to the first sliding surface 12, when viewed in the usable orientation, the second sliding 14 surface includes a bottom portion 22 on which a user can slide, and a pair of upstanding side walls 24, 26 configured to prevent a user from falling therefrom. It will be readily recognized from the figures that only one of the first and second sliding surfaces 12, 14 can be used at any one time.

The sliding surfaces 12, 14 are connected to one another by outer walls 28, 30. The outer walls 28, 30 are contiguous with the upstanding walls of the sliding surfaces, i.e., outer wall 28 is contiguous with upstanding walls 18 and 24, and outer wall 30 is contiguous with upstanding walls 20 and 26.

The outer walls 28, 30 provide rigidity and stability to the overall slide 10 structure. As shown in the figures, the outer walls 28, 30 may include designs, embossings and the like, such as the design D, to enhance the aesthetic appeal of the slide 10.

The bottom portion 16, 22 of each of the sliding surfaces 12, 14 has a generally arcuate, upwardly concave cross-sectional shape when viewed from the usable or upward orientation, as illustrated at 32. The concave cross-sectional shape 32 provides a chute-like pathway 34 along the sliding surface 12. The chute-like pathway 34 directs the user down, along the sliding surface 12, rather than outward toward the sides 18, 20 thereof.

The sliding surfaces 12, 14 may include curves therein in both the vertical direction, i.e., downward curves as illustrated at 36, and in the horizontal direction, i.e., side-to-side curves as illustrated at 38. Such curves 36, 38 enhance the enjoyment of the child using the slide 10, and provide options and additions to slide system designs, as more fully discussed herein.

As best seen in FIG. 2, the sliding surfaces 12, 14 are in back-to-back relation with one another. Thus, when the slide 10 is viewed with the first sliding surface 12 in the usable or upward orientation, it is a reverse mirror image of the slide when viewed with the second surface 14 in the usable or upward orientation. Thus, one slide 10 configuration can be used in a variety of slide system design alternatives.

The slide 10 includes mounting surfaces 40*a–d* thereon to facilitate mounting the slide 10 to an associated support structure. Preferably, the mounting surfaces 40*a–d*, are symmetrically opposed, at about a juncture of the outer walls 28, 30 and respective side walls 18, 24 and 20, 26 of each sliding surface 12, 14 as illustrated at 42.

In a current embodiment, the slide 10 is molded in a rotational molding process. A preferred material for the slide formed in such a rotational molding process is low density polyethylene. Those skilled in the art will readily recognize that such materials can be colored, with for example, ultraviolet-stabilized coloring compounds, as part of the molding process.

Other molding processes and materials may of course be used to manufacture the slide of the present invention. Such other molding processes and materials are intended to be within the spirit and scope of the present invention.

Figure 5:
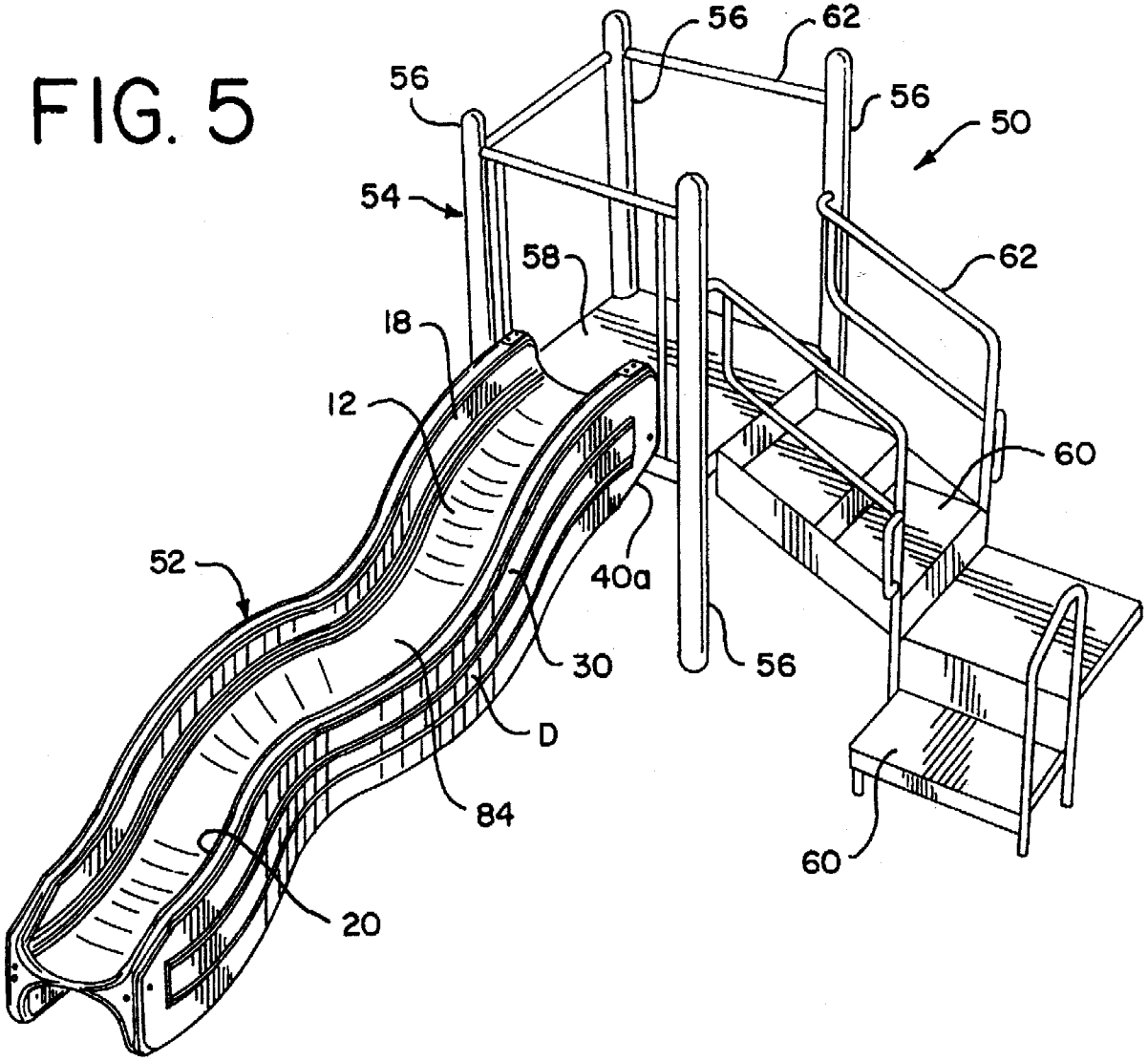
FIG. 5 is a perspective view of a slide system illustrated with angle slide mounted to a slide tower.

FIG. 5 illustrates one embodiment of a slide system 50 in accordance with the present invention. The slide system 50 includes a single slide 52, and a slide support structure or slide tower 54. The tower 54 includes a plurality of standards or uprights 56 to support the structure. The tower uprights 56 may be formed of galvanized steel, aluminum and the like. Other suitable, structural materials may be used to form the uprights 56. Optionally, the uprights may be coated, such as by powder coating, to prolong the life of the structural components and to create an aesthetically appealing structure.

The tower may include platforms 58 and stairs 60 or rungs (not shown) to provide access to the platforms 58. Other features may be included as part of or appurtenant to the tower 54 to create more or less challenging activities for the child using the slide system 50. Additionally, guard rails 62 or hoods may be included to enhance the safety features thereof.

Figure 6:
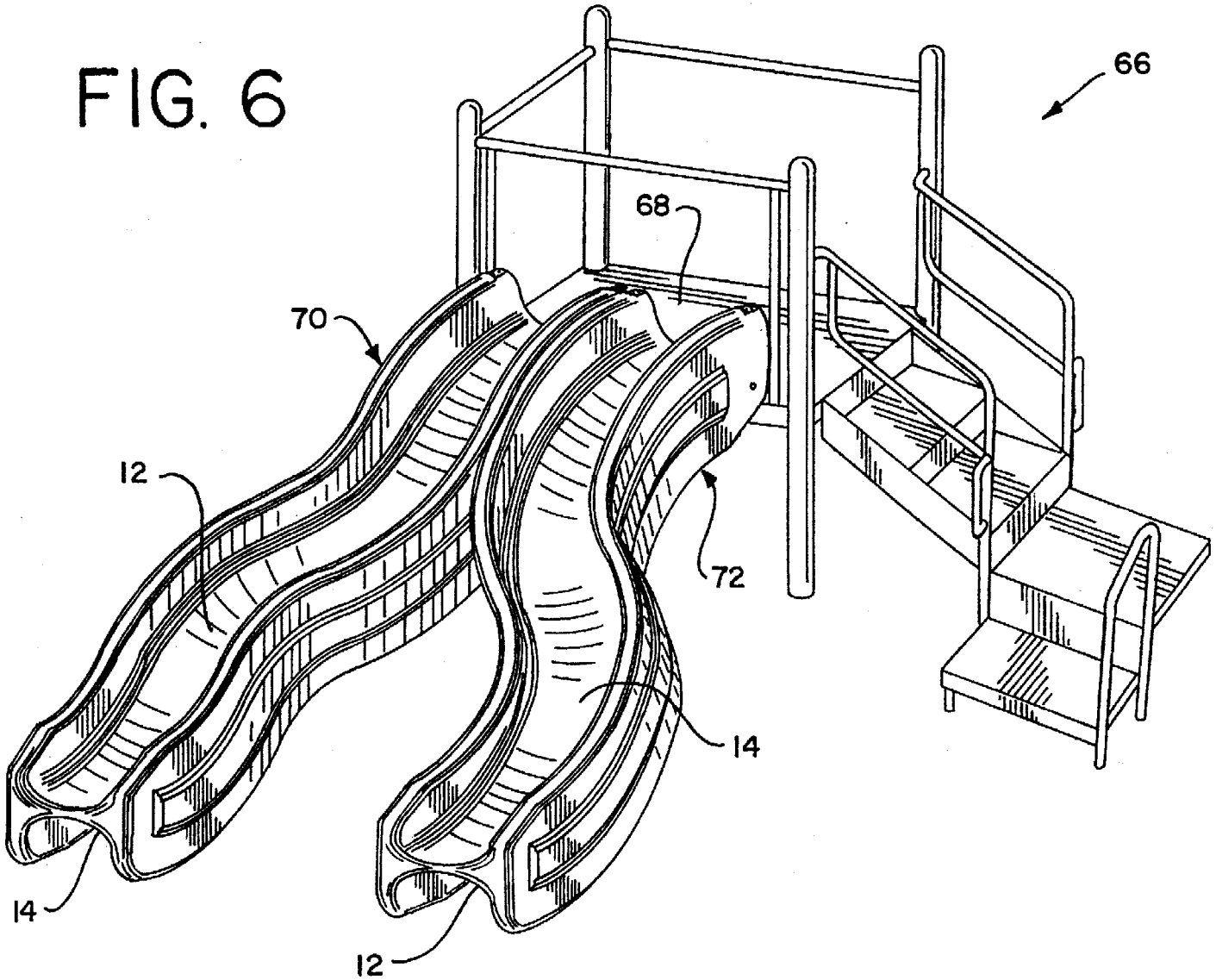
FIG. 6 is a perspective view of another slide system illustrated with a pair of slides mounted to a slide tower.

A two slide system 66 is illustrated in FIG. 6. The two slide system 66 is similar to the system 50 illustrated in FIG. 5, except that a larger platform 68 is used to accommodate two slides 70, 72. Advantageously, as will be recognized by those skilled in the art, the first and second slides 70, 72 are identical.

In the exemplary system 66 illustrated in FIG. 6, the slide 70 shown on the left hand side of the system 66 is illustrated with the first sliding surface 12 in the usable or upward orientation. Conversely, the slide 72 shown on the right hand side of the system 66 is illustrated with the second sliding surface 14 in the usable or upward orientation. The slides 70, 72 are otherwise identical, and are simply reversed, relative to the sliding surfaces 12, 14.

Thus, through use of a single slide design having opposingly oriented sliding surfaces, the design options available for slide systems are greatly enhanced, while the overall costs associated with forming or molding the slides are reduced. Such a configuration provides advantages in both cost savings and design flexibility.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A molded, two-surface, reversible slide, comprising:

a first, elongated sliding surface, said first surface having a bottom portion defining a generally, concave cross-sectional shape, and being elongated in a direction transverse to said concave cross-section, said first surface having a pair of side walls extending from said bottom portion; and a second, elongated sliding surface, said second surface having a bottom portion defining a generally, concave cross-sectional shape, and being elongated in a direction transverse to said concave cross-section, said second surface having a pair of side walls extending from said bottom portion, wherein said first and second sliding surfaces are in a back-to-back relation with one another, and wherein each of said side walls of said first surface is formed contiguous with a respective one of said side walls of said second sliding surface, defining first and second outer walls.

2. The slide according to claim 1, wherein said first and second sliding surfaces are reverse mirror images of one another.

3. The slide according to claim 1 wherein at least one of said first and second sliding surfaces includes at least one curved portion therein extending along said elongated direction.

4. The slide according to claim 1 wherein at least one of said first and second sliding surfaces includes at least one curved portion therein extending generally transverse to said elongated direction.

5. A molded, two-surface, reversible slide comprising first and second concave sliding surfaces, said sliding surfaces having a common elongated dimension along a slide pathway generally transverse to said concave cross-section, said sliding surfaces being in back-to-back relation with one another, wherein only one of said first and second sliding surfaces is usable at a time.

6. The slide according to claim 5, wherein said first and second sliding surfaces are in reverse mirror relation with one another.

7. A slide system comprising:

a support structure; and at least one slide mounted thereto, said slide having first and second elongated sliding surfaces, each said sliding surface having a bottom portion defining a generally, concave cross-sectional shape, and being elongated in a direction transverse to said concave cross-section, each said surface having a pair of side walls extending from a respective bottom portion, wherein said first and second sliding surfaces are in a back-to-back relation with one another, and wherein said slide is reversible wherein only one of said first and second sliding surfaces is usable at a time.

8. The slide system according to claim 7 wherein each of said side walls of said first sliding surface is formed contiguous with a respective one of said side walls of said second sliding surface, defining first and second outer walls.

9. The slide system according to claim 7 including two slides mounted to said support structure.

10. The slide system according to claim 9 wherein one of said slides is oriented with said first sliding surface in a usable orientation and wherein the other of said slides is oriented with said second sliding surface in a usable orientation.

* * * * *